US008109194B2

(12) United States Patent
Stone

(10) Patent No.: US 8,109,194 B2
(45) Date of Patent: Feb. 7, 2012

(54) CLAMPED GAS BLOCK FOR BARREL

(75) Inventor: Jeffrey W. Stone, Elizabethtown, KY (US)

(73) Assignee: RA Brands, L.L.C., Madison, NC (US)

( * ) Notice: Subject to any disclaimer, the term of this patent is extended or adjusted under 35 U.S.C. 154(b) by 163 days.

(21) Appl. No.: 12/727,052

(22) Filed: Mar. 18, 2010

(65) Prior Publication Data

US 2010/0236396 A1 Sep. 23, 2010

Related U.S. Application Data

(60) Provisional application No. 61/162,099, filed on Mar. 20, 2009.

(51) Int. Cl.
*F41A 5/26* (2006.01)
*F41C 27/00* (2006.01)
*F16B 2/06* (2006.01)

(52) U.S. Cl. ..... 89/193; 42/85; 24/2.5; 248/230.5

(58) Field of Classification Search ..... 89/191.01, 89/191.02, 192, 193; 42/85; 24/2.5, 335, 24/527; 248/230.1, 230.5; D08/394, 396
See application file for complete search history.

(56) References Cited

U.S. PATENT DOCUMENTS

| | | | |
|---|---|---|---|
| 1,735,160 | A | 11/1929 | Destree |
| 1,996,124 | A | 4/1935 | Rowley |
| 2,093,706 | A | 9/1937 | Browning |
| 2,186,582 | A | 1/1940 | Gebauer |
| 2,637,247 | A | 5/1953 | Hester |
| 2,987,968 | A | 6/1961 | Janson |
| 3,306,168 | A | 2/1967 | Blumrick |
| 3,443,477 | A | 5/1969 | Kaempf |
| 3,444,641 | A | 5/1969 | Ruger |
| 3,568,564 | A | 3/1971 | Badali |
| 3,592,101 | A | 7/1971 | Vartanian et al. |
| 3,601,002 | A | 8/1971 | Janson |

(Continued)

FOREIGN PATENT DOCUMENTS

DE 41 36 665 A1 5/1993

(Continued)

OTHER PUBLICATIONS

International Search Report for related PCT application No. PCT/US2010/027916, mailed Jun. 21, 2010.

(Continued)

*Primary Examiner* — Bret Hayes
(74) *Attorney, Agent, or Firm* — McGuireWoods, LLP; Charles J. Gross

(57) ABSTRACT

A gas block clamping apparatus for a firearm includes a plurality of sections, each including a shaped upper section, and a lower cylindrical section to which the shaped upper section is attached. A plurality of clamp sections are symmetrically disposed on opposite sides of a barrel of the firearm, each clamp section having an upper surface for attaching the gas block to the barrel, a curved surface that aligns the clamp section to an outer surface of the barrel when the clamp sections are tightened, and a lower surface that aligns with the shaped upper section of the gas block. A plurality of fasteners are disposed through a plurality of openings in the lower surface of the clamp sections and the shaped upper surface of the gas block for securing each clamp section to both the barrel and gas block.

21 Claims, 6 Drawing Sheets

U.S. PATENT DOCUMENTS 3,675,534 A 7/1972 Beretta
3,680,434 A 8/1972 Muhlemann
3,707,110 A 12/1972 Alday
3,709,092 A 1/1973 Tazome
3,715,955 A * 2/1973 Folley et al. ..... 89/193
3,776,096 A 12/1973 Donovan
3,810,412 A 5/1974 Zamacola
3,945,296 A 3/1976 Hyytinen
3,988,964 A * 11/1976 Moore ..... 89/185
3,990,348 A 11/1976 Vesamaa
3,999,534 A 12/1976 Chapin et al.
4,014,247 A 3/1977 Tollinger
4,015,512 A 4/1977 Feerick
4,026,055 A 5/1977 Weast
4,085,654 A 4/1978 Panigoni
4,102,242 A 7/1978 Liedke
4,109,558 A 8/1978 Panigoni
4,373,423 A 2/1983 Moore
4,389,920 A 6/1983 Dufour, Sr.
4,409,883 A 10/1983 Nyst
4,414,880 A 11/1983 Throner
4,475,438 A 10/1984 Sullivan
4,505,183 A 3/1985 Grehl
4,563,937 A 1/1986 White
4,599,934 A 7/1986 Palmer
4,702,146 A 10/1987 Ikeda et al.
4,709,617 A 12/1987 Anderson
4,765,224 A 8/1988 Morris
4,872,392 A 10/1989 Powers et al.
4,901,623 A 2/1990 Lee
4,941,277 A 7/1990 Lawlor
5,173,564 A 12/1992 Hammond, Jr.
5,218,163 A 6/1993 Dabrowski
5,272,956 A 12/1993 Hudson
5,351,598 A 10/1994 Schuetz
5,404,790 A 4/1995 Averbukh
5,448,940 A 9/1995 Schuetz et al.
5,471,777 A * 12/1995 McDonald ..... 42/132
5,499,569 A 3/1996 Schuetz
5,520,019 A 5/1996 Schuetz
5,726,377 A 3/1998 Harris et al.
5,767,434 A 6/1998 Hirtl et al.
5,768,818 A 6/1998 Rustick
5,824,943 A 10/1998 Guhring et al.
5,827,992 A 10/1998 Harris et al.
5,831,202 A 11/1998 Rustick
5,867,928 A 2/1999 Plebani
5,872,323 A 2/1999 Norton et al.
5,907,919 A 6/1999 Keeney
5,913,669 A * 6/1999 Hansen et al. ..... 42/146
5,937,558 A 8/1999 Gerard
5,939,659 A 8/1999 Dobbins
5,945,626 A 8/1999 Robbins
5,959,234 A 9/1999 Scaramucci et al.
5,983,549 A 11/1999 Battaglia
6,029,645 A 2/2000 Wonisch et al.
6,318,230 B1 11/2001 Bamber
6,347,569 B1 2/2002 Butler
6,374,528 B1 4/2002 Davis et al.
6,381,895 B1 5/2002 Keeney et al.
6,382,073 B1 5/2002 Beretta
6,421,946 B1 6/2002 LoRocco
6,508,160 B2 1/2003 Beretta
6,564,691 B2 5/2003 Butler
6,606,934 B1 8/2003 Rock et al.
6,619,592 B2 9/2003 Vignaroli et al.
6,662,485 B2 12/2003 Kay
6,775,942 B2 6/2004 Compton
6,886,286 B2 5/2005 Dowding
6,971,202 B2 12/2005 Bender
7,162,823 B2 1/2007 Schoppmann et al.
7,252,138 B2 8/2007 Burkhalter et al.
7,311,032 B2 12/2007 Murello
7,343,844 B2 3/2008 Poff, Jr.
7,418,898 B1 9/2008 DeSomma
7,448,307 B1 11/2008 Dafinov
7,461,581 B2 12/2008 Leitner-Wise
7,467,581 B2 12/2008 Botty
7,469,624 B1 * 12/2008 Adams ..... 89/191.01
7,775,150 B2 8/2010 Hochstrate et al.
2001/0054350 A1 12/2001 Beretta
2002/0073832 A1 6/2002 Vignaroli et al.
2002/0096042 A1 7/2002 Adkins
2002/0139362 A1 10/2002 Shipachev et al.
2005/0016374 A1 1/2005 Pescini
2005/0223613 A1 10/2005 Bender
2005/0235817 A1 10/2005 Murello
2005/0257681 A1 11/2005 Keeney et al.
2005/0268516 A1 12/2005 Nelson
2006/0065112 A1 3/2006 Kuczynko et al.
2006/0283318 A1 12/2006 Beaty
2007/0012169 A1 1/2007 Gussaili

FOREIGN PATENT DOCUMENTS

EP 0 789 217 1/1997
EP 1 215 464 A 6/2002
EP 1 380 808 A1 1/2004
EP 1 624 275 A 2/2006
FR 2 686 152 7/1993
GB 214 505 A 4/1924
RU 2 089 811 C1 11/1994
RU 2279028 C1 6/2006

OTHER PUBLICATIONS

Written Opinion for related PCT Application No. PCT/US2010/027916, mailed Jun. 21, 2010.
International Search Report for related PCT Application No. PCT/US2010/012364, mailed Oct. 27, 2008.
Written Opinion for related PCT Application No. PCT/US2010/012364, mailed Oct. 27, 2008.
International Search Report for related PCT application No. PCT/US2008/074601, mailed Jul. 21, 2009.
Written Opinion for related PCT Application No. PCT/US2008/074601, mailed Jul. 21, 2009.

* cited by examiner

CLAMPED GAS BLOCK FOR BARREL

CROSS-REFERENCE TO RELATED APPLICATIONS

This application claims the benefit of U.S. Provisional Patent Application No. 61/162,099, filed Mar. 20, 2009.

INCORPORATION BY REFERENCE

U.S. Provisional Patent Application No. 61/162,099, which was filed on Mar. 20, 2009, is hereby incorporated by reference for all purposes as if presented herein in its entirety.

TECHNICAL FIELD

Embodiments of the disclosure are directed generally to gas operated firearms and, more particularly, to an apparatus for clamping a gas block to the barrel of a gas-operated firearm.

BACKGROUND INFORMATION

Semi-automatic firearms, such as rifles and shotguns, are designed to fire a round of ammunition, such as a cartridge or shot shell, in response to each squeeze of the trigger of the firearm, and thereafter automatically load the next shell or cartridge from the firearm magazine into the chamber of the firearm. During firing, the primer of the round of ammunition ignites the propellant inside the round, producing an expanding column of high pressure gases within the chamber and barrel of the firearm. The force of this expanding gas propels the bullet/shot of the cartridge or shell down the barrel.

In semi-automatic rifles and shotguns, a portion of the expanding gases typically are directed through a duct or port that interconnects the barrel of the firearm to a piston assembly that generally houses an axially moveable piston. This piston assembly further typically includes a gas block that connects the piston assembly to the barrel, and through which the explosive gases pass. In some systems, the gas blocks are one piece elements located on their firearms and aligned with the port in the barrel through which the gases from the fired cartridge flow into the gas block and back to the action for expelling the spent cartridge and for chambering a fresh cartridge. The portion of the explosive gases that are diverted from the barrel of the firearm act upon the piston so as to force the piston in a rearward direction to cause the rearward motion of the bolt of the firearm. This rearward motion of the bolt opens the chamber, ejects the empty shell or cartridge casing, and thereafter loads another shell or cartridge into the chamber, after which the bolt returns to a locked position for firing as the gases dissipate or are bled off.

SUMMARY OF THE DISCLOSURE

Briefly described, in one embodiment of the invention, a gas block clamping apparatus is provided for use with a gas-operated firearm. The gas block can comprise a plurality of sections, including an upper section and a lower cylindrical section to which the upper section is attached. The upper section further can have a profile that is shaped or configured to facilitate its fitting to and mounting along the barrel. A plurality of clamp sections are symmetrically disposed on opposite sides of the barrel. Each clamp section can have an upper surface for attaching the gas block to the barrel, an alignment surface that tends to facilitate alignment of the clamp section to the barrel when the clamp sections are tightened against the barrel, and a lower surface that aligns with the curved upper section of the gas block. A plurality of fasteners generally are disposed through a plurality of openings in the lower surface of the clamp sections and the upper surface of the gas block for securing each clamp section to both the barrel and gas block.

These and various other advantages, features, and aspects of the exemplary embodiments will become apparent and more readily appreciated from the following detailed description of the embodiments taken in conjunction with the accompanying drawings, as follows.

DETAILED DESCRIPTION OF THE EXEMPLARY EMBODIMENTS

Figure 1:
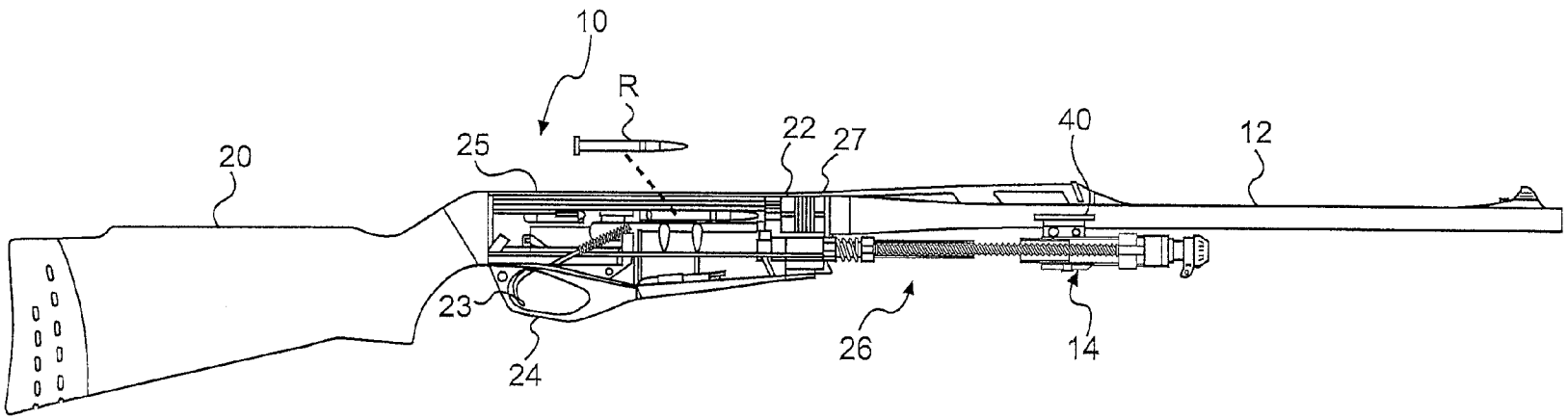
FIG. 1 illustrates a gas-operated firearm showing the positioning of the clamped gas block in an exemplary embodiment.

Referring now to the drawings in which like numerals indicate like parts throughout the several views, the figures illustrate one example embodiment of the clamped gas block apparatus or system according to the principles of the present disclosure for use in a firearm such as a rifle. However, it will be understood that the clamped gas block apparatus can be used in various types of firearms including shotguns and other long guns, hand guns, and other gas-operated firearms. The following description is provided as an enabling teaching of exemplary embodiments; and those skilled in the relevant art will recognize that many changes can be made to the embodiments described, while still obtaining the beneficial results. It will also be apparent that some of the desired benefits of the embodiments described can be obtained by selecting some of the features of the embodiments without utilizing other features. Accordingly, those who work in the art will recognize that many modifications and adaptations to the embodiments described are possible and may even be desirable in certain circumstances, and are a part of the invention. Thus, the following description is provided as illustrative of the principles of the embodiments and not in limitation thereof, since the scope of the invention is defined by the claims.

FIG. 1 illustrates a gas-operated firearm 10 showing the positioning of the clamped gas block apparatus or system in one exemplary embodiment. Gas-operated firearm 10 generally includes barrel 12, stock 20, receiver 22, fire control 24, and the clamped gas block apparatus or system 40, including a gas block 14. The stock 20, also known as the buttstock or shoulder stock, may be formed in any conventional manner to include cushioning, special curvatures, grips, etc. The receiver 22 houses and includes the firing mechanism or fire control 24, including a trigger 23 for actuating the firearm a breech bolt or bolt assembly 25, and a firing pin. The bolt assembly is translatable axially in both forward and rearward directions along the receiver during the firing cycle and generally is located behind a chamber portion 27 located at the proximal end of the barrel 12 adjacent the receiver 22. The chamber receives a round of ammunition R, such as a shell or cartridge for firing.

In the gas-operated semi-automatic firearm 10 illustrated in FIG. 1, a gas-operated piston assembly 26 is provided for reloading the chamber after firing by way of mechanical interconnection and interaction between the gas redirecting piston assembly and the bolt. During a firing operation, a portion of the expanding gas in the barrel is redirected into the gas block assembly 14 to drive the gas piston rearward. The action of the gas piston, which in turn is translated to the bolt, functions to automatically clear or discharge a spent cartridge/shell casing from the chamber, load a new round R into the chamber, and recock the firing pin and bolt for a next firing cycle.

According to one embodiment of the clamped gas block apparatus or system 40, as shown in FIGS. 2, 4A, 4B, and 5, generally symmetric clamp sections 42 of the clamped gas block apparatus 40 attach the gas block 14 to the barrel 12 by engaging one or more cut out sections (i.e., notches, recesses, or other depressions or other engaging areas) 16 formed along the outer surface of the barrel 12. Each of the notches 16 generally is an elongate slot with a lower lip 16*a* adapted to engage or cooperate with one of the clamp sections 42. The notches extend at least partially along the length of the barrel 12, generally parallel with the central axis of the barrel, and can be situated below the horizontal centerline of the barrel. In a particular exemplary embodiment, the notches 16 can be machined into the outer surface of the barrel 12. Additionally, various shapes and orientations of the notches 16 are considered to be within the scope of the present invention. For example, all or part of the notches, and/or the entirety or a portion of the notches themselves, can be formed or oriented generally transverse to the central axis of the barrel 12.

Figure 3A:
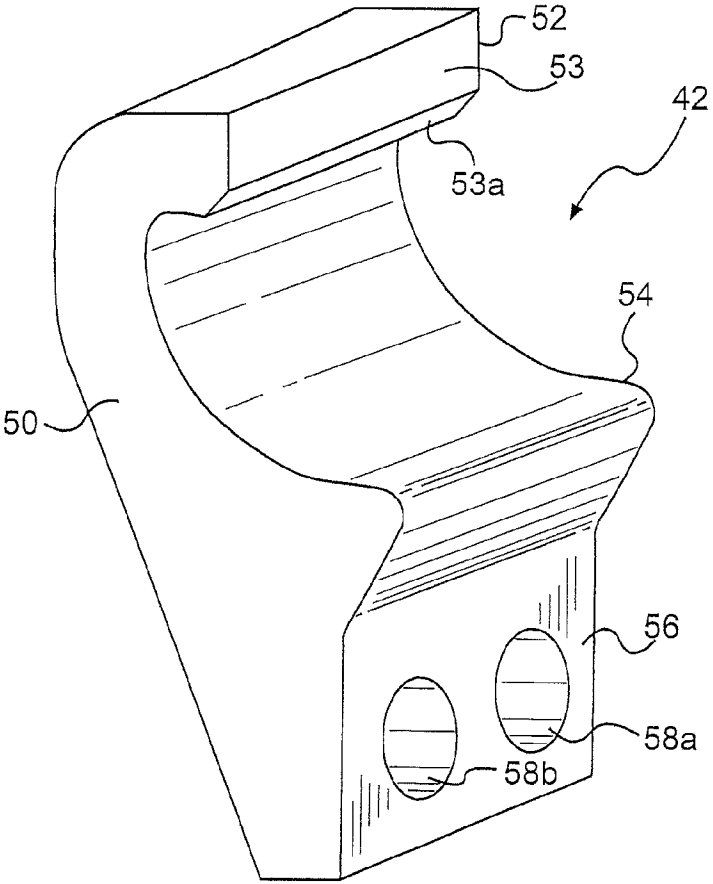
FIG. 3A is an isometric view of a clamp section of the clamped gas block of FIG. 2.

FIG. 3A shows an isometric view of a clamp section 42 according to one embodiment of the present disclosure. As illustrated, the clamp section 42 can include a generally C-shaped member 50, a top portion 52, a clamp protrusion 54, and a lower flange 56, which can include through-bores 58*a*, 58*b*. In the illustrated embodiment, the top portion 52 is generally hook-shaped or otherwise configured to facilitate its engagement with its corresponding notch 16 (FIGS. 4A, 4B, and 5) and to resist moments on the top portion 52 that would otherwise pivot the top portion away from the barrel 12. Additionally, various shapes and orientations of the top portion 52 are considered to be within the scope of the present invention. For example, all or part of an alternative embodiment of the top portion can be generally vertically oriented or arranged.

The top portion 52 further can include a lip 53 that projects laterally and can have one or more beveled engaging surfaces 53*a*. The lip 53 generally will be sized so as to engage and fit within a corresponding notch and create a substantially cantilevered, locked engagement between the clamp section and the barrel. The clamp protrusion 54 of each clamp section can be configured to engage a curved upper flange 18 supported by a bracket 17 of the gas block 14. The bracket 17 generally is mounted to or integral with a gas expansion housing 19 of the gas block 14. The upper flange 18 is mounted to or integral with the bracket 17. In a particular exemplary embodiment shown in FIG. 3B, the clamp protrusion 54 engages the curved flange 18 at a point where the outer surface of the flange extends at about a 30° angle ($\theta_A$) with respect to the horizontal. Alternatively, the angle $\theta_A$ of the flange can be formed in a range of about 1° to about 89°.

The lower flange 56 can extend downward from the clamp protrusion 54 so that the bores 58*a*, 58*b* are generally aligned with through-bores 60 in the bracket 17. Bore 58*b* can be configured to accommodate a fastener with an enlarged screw head at the outer surface of the clamp section 42 (FIG. 5) and have a clearance fit with the shoulder of the fastener or screw head. The bore 58*a* also can be threaded or otherwise adapted to receive the end of another fastener as well. The clamp sections 42 can be generally identical so that the screw head of screw 46, which is closest to the receiver 22 in the figures, is on the left in FIG. 4A and the screw head of screw 48 is on the right in FIG. 4A. The bores 60 in the bracket 17 further can be configured for a clearance fit with screws or other fasteners 46, 48. The fasteners 46, 48 can be, for example, low head socket cap screws such as a screw having a hexalobular internal driving feature, such as those sold under the trademark TORX®. Alternatively, the fasteners 46, 48 can include a variety of different type fasteners, including fasteners having a socket head cap, a low head socket cap, button head socket cap, flat head socket cap, or another fastener, including fasteners with a head diameter greater than the major diameter of the fastener. Such headed fasteners further can range from ASTM #0 to ½-inch diameter or greater fasteners and can have a pitch diameter as desired or needed for attachment of the clamp sections in view of the size and/or clamping engagement thereof.

In accordance with an alternative embodiment of the present disclosure, the bores 58*a*, 58*b* may be otherwise arranged without departing from the scope of this disclosure. For example, the bores can be configured so that both fastener openings or fastener heads are on the same side of the gas block. Alternatively, the bracket 17 can be provided with threaded bores 60 and four fasteners such as screws can secure the lower flange 56 to the bracket 17. In a further alternative, the bore 58*b* can be a threaded blind bore.

Figure 4B:
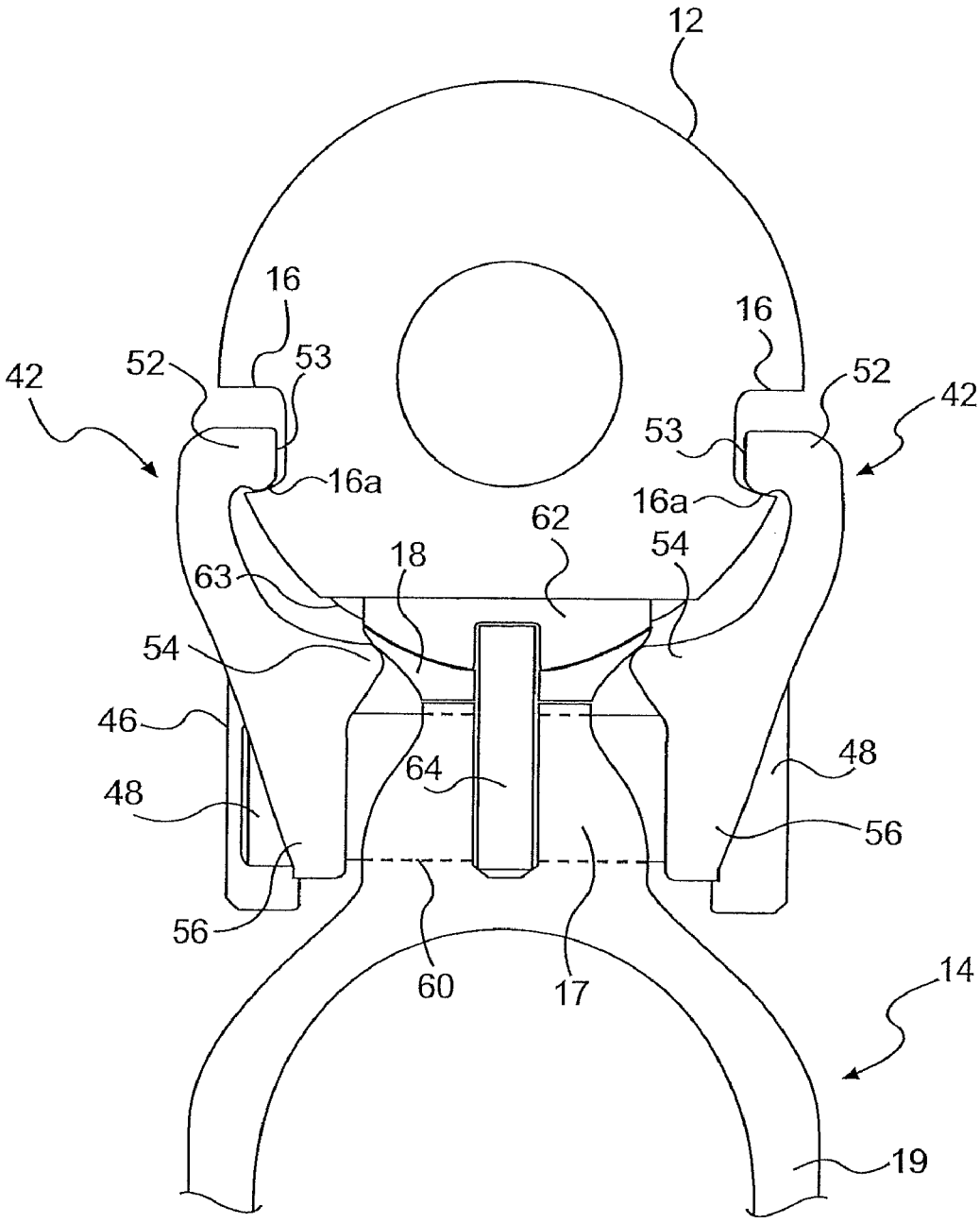
FIG. 4B is a cross-sectional view of the clamped gas block and firearm barrel in an exemplary embodiment.
Figure 5:
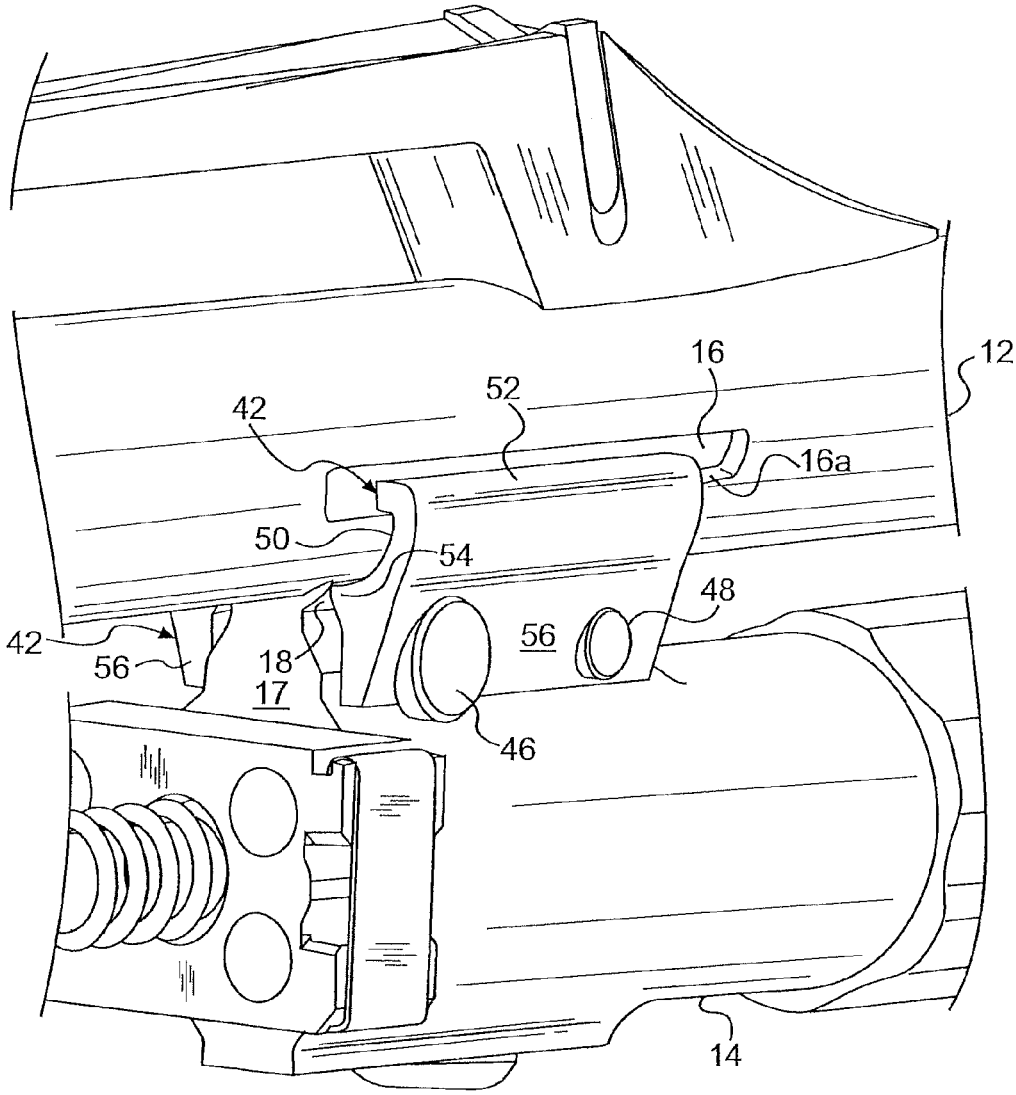
FIG. 5 is an enlarged perspective view of the clamp section attached to the firearm barrel and clamped gas block in an exemplary embodiment.

As shown in FIG. 4B, the upper flange 18 can have a contoured or shaped profile, including a concave inner surface for cradling a lower surface of an alignment element 62 situated in a recess 63 machined into or otherwise formed in the lower surface of the barrel 12. The upper flange 18 can also have a convex outer surface for engaging the clamp protrusions 54 of the clamp sections 42. A gas port 13*b* (shown in phantom in FIG. 4A) communicates from the upper flange 18 though the bracket 17 to the housing 19. The gas port 13*b* is to be aligned with a gas duct 13*a* (shown in phantom in FIG. 4A), communicating between an interior of the barrel and an exterior of the barrel. The gas port and gas duct are shown in phantom in FIG. 4A.

The alignment element 62 can have a curved, convex surface for engaging the upper flange 18 and a generally flat surface for engaging the barrel 12 in the recess 63. In the illustrated embodiment, the element 62 fits tightly within the recess 63 in the direction of the length of the barrel 12. The recess 63 allows the element 62 to be adjusted in the direction transverse to the length of the barrel. One or more alignment pins 64 each engages a blind alignment bore in the element 62 and a blind alignment bore in the bracket 17. The alignment pin 64 can have an interference fit with the bracket 17, the element 62, or both. The alignment pin 64 and the alignment bores of the element 62 and the bracket 17 also can be offset along the length of the barrel 12 in the illustrated embodiment. In one particular exemplary embodiment, the element 62 and recess 63 can be shorter than the upper flange 18 and clamp sections 42 so that a portion of the upper flange 18 engages the element 62 and another portion of the upper flange 18 engages the barrel 12 directly. The gas duct 13*a* and gas port 13*b* can line up where the upper flange engages the barrel directly. In an another exemplary embodiment, the element 62 and recess 63 are substantially the same length as or longer than the upper flange 18 and claim sections 42 so that the upper flange 18 only engages the element 62. The element 62 can include a through bore for communicating between the gas port 13*b* and the gas duct 13*a*.

Figure 2:
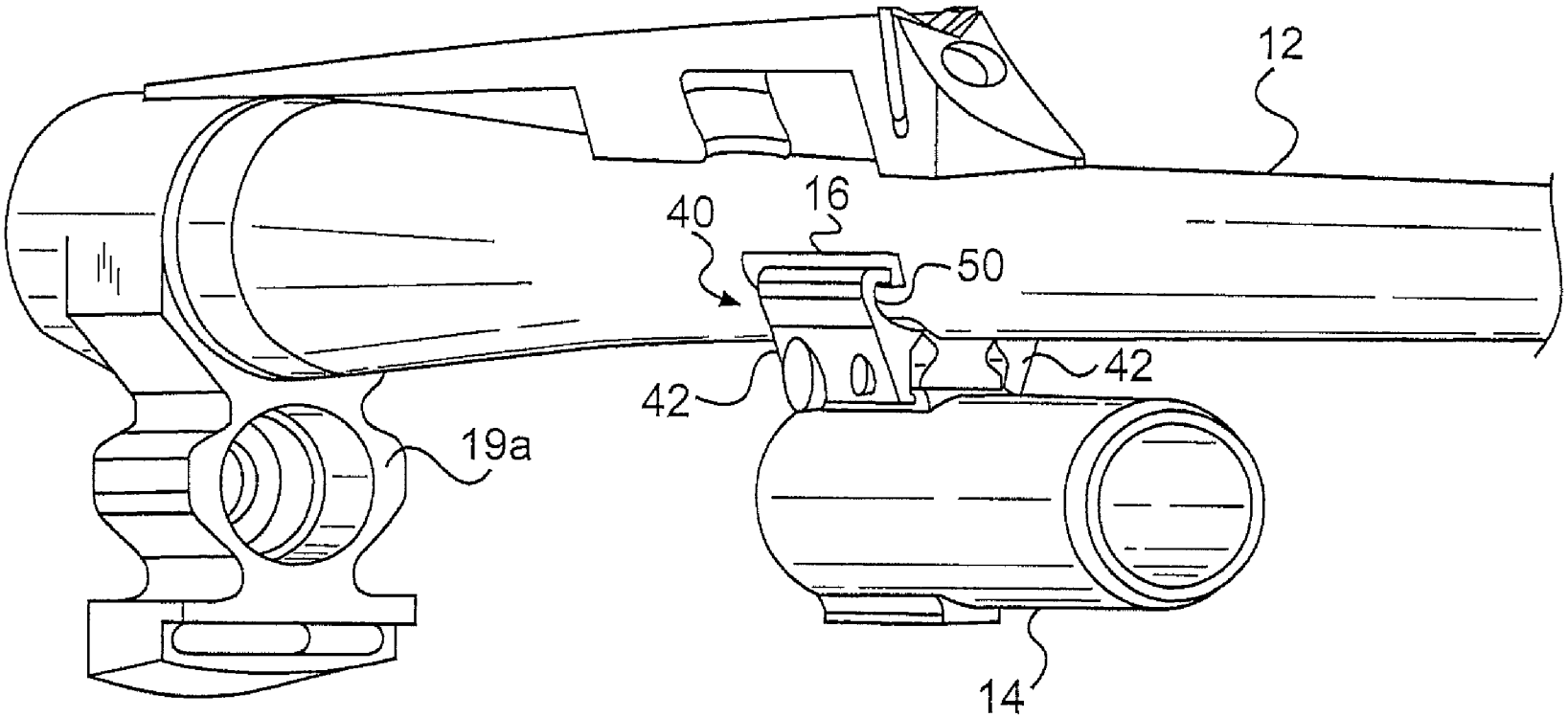
FIG. 2 is a perspective view of clamped gas block attached to the firearm barrel in an exemplary embodiment.
Figure 4A:
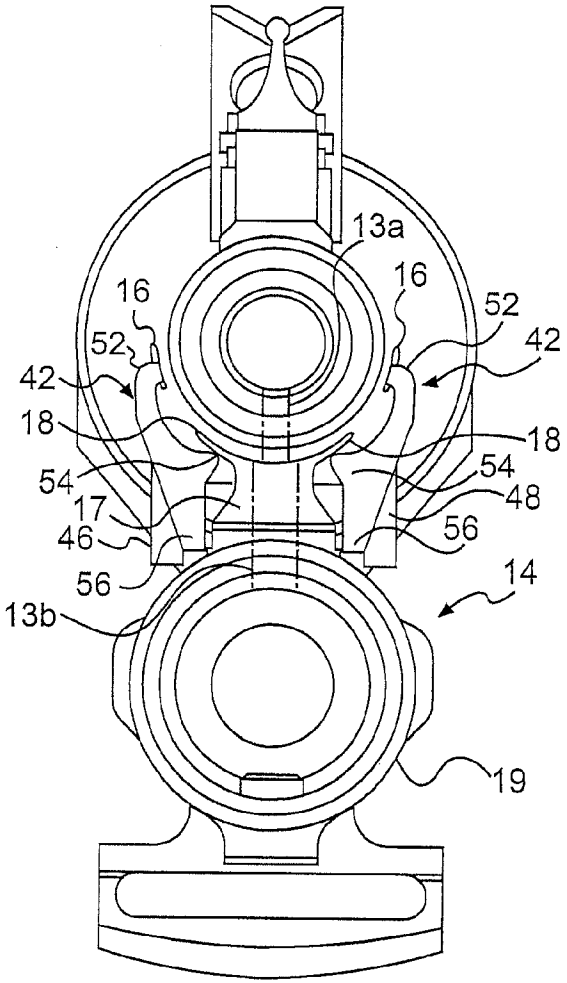
FIG. 4A is an end view of the clamp sections mounted to the firearm barrel and clamped gas block in an exemplary embodiment.

The clamped gas block self aligns so that the gas port 13*b* communicates with the gas duct 13*a*. Particularly, the clamped gas block is aligned along the direction of the length of the barrel 12 when the alignment element 62 and the alignment pin 64 are assembled onto the bracket 17, and the element 62 is inserted into the recess 63 as shown in FIG. 4B. Each of the notches 16 provides clearance for the top portion 52 for adjusting the alignment of the respective clamp section 42 along the length of the barrel 12 and transverse to the length of the barrel so that the fasteners 46, 48 can be inserted into the bores 58*a*, 58*b* in the clamp sections 42 and the bores 60 in the bracket 17. The tightening of the fasteners 46, 48 in an alternating fashion applies a laterally directed force against the clamp sections so as to generally pull the clamp sections 42 together and aligns the clamped gas block in the transverse direction so that the axis of the housing 19 is substantially aligned with the axis of the barrel 12 and the gas port 13*b* communicates with the gas duct 13*a*. A guide rod (not shown) can be used to further align housing with a rearward portion 19*a* of the piston assembly 26 (FIG. 2). A suitable clamping device such as a vise or locking pliers also can be used to hold the clamp sections 42 to the barrel 12 during assembly as needed.

Tightening the clamping screws 46, 48 or other, similar fasteners draws the gas block subassembly 14 to the barrel 12 to seal the system. When the clamp sections 42 are tightened, the top portions 52 of each clamp section 42 pull generally downwardly against the lower lips 16*a* of the notches 16 and the clamp protrusions 54 force the flange 18 against the alignment element 62, which applies a generally upwardly directed clamping force to the lower surface of the barrel 12 in the recess 63. The forces are distributed at the curved flange 18 and integrated into the gas block 14. In the illustrated embodiment, each of the clamp sections 42 acts as a class 2 lever or cantilever, wherein the fasteners 46, 48 apply a lateral force drawing the lower flanges 56 inward causing the clamp protrusions 54 to clamp the upper flange 18 in inward and upward directions against the barrel 12 via element 62 while the top portions 52 resist the reaction forces pulling downwardly on the lips 16*a*.

Figure 3B:
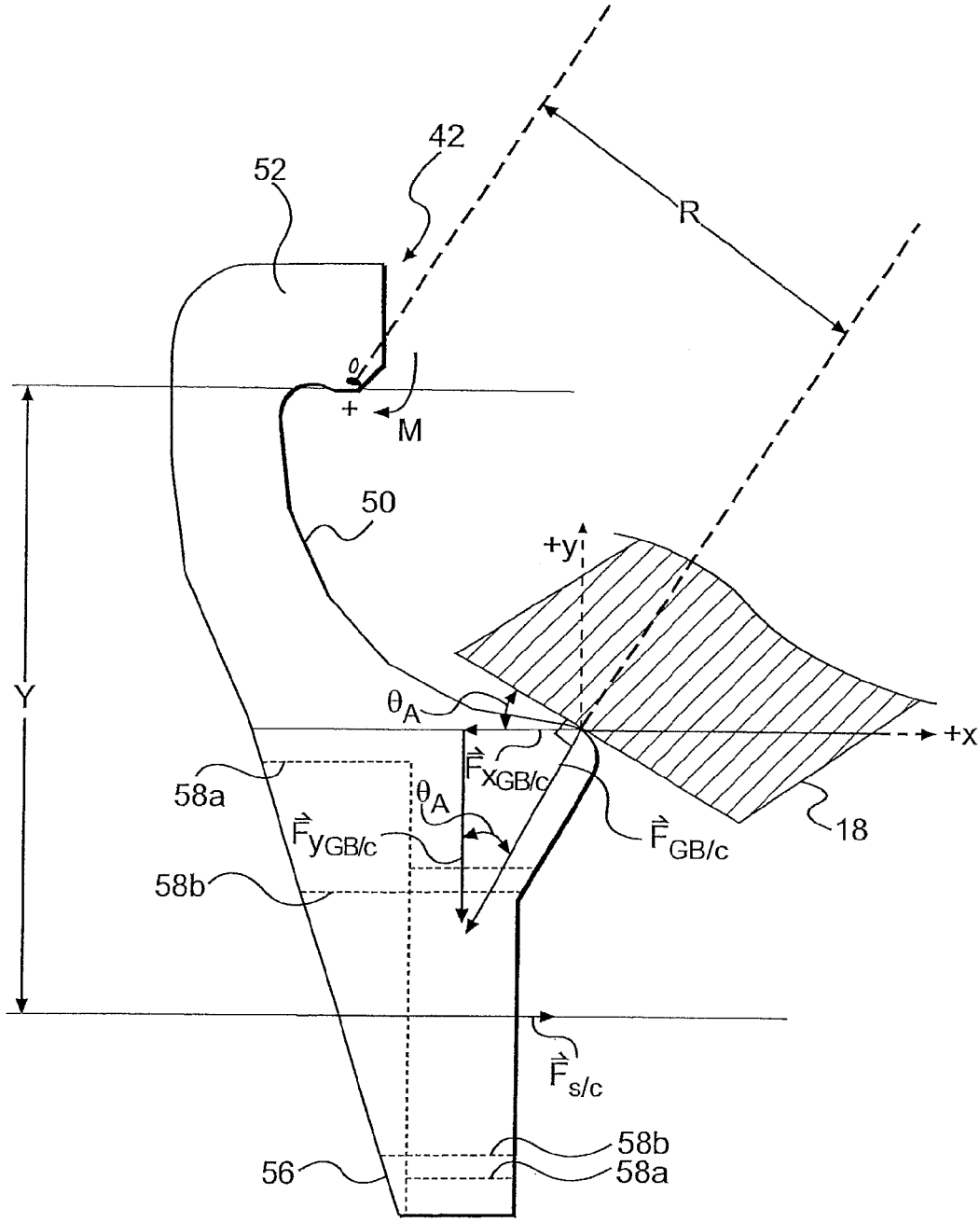
FIG. 3B is an end view of the clamp section of FIG. 3A illustrating example force vectors applied to the clamp section.

FIG. 3B illustrates the force vectors applied to one of the clamp sections 42 during mounting of the gas block 14 to the firearm barrel 12. The moments associated with the force of the gas block on the clamp ($F_{GB/C}$) and the force of the screw on the clamp ($F_{S/C}$) are substantially equal and opposite; i.e., the sum of the moments acting on the section 42 about any point on the section 42 generally are zero. With reference to FIG. 3B, the clamp force analysis for the clamp gas block apparatus is as follows:

$$\Sigma M_0=0=F_{GB/C}(R)-F_{S/C}(Y)=>$$

$$F_{GB/C}=(Y/R)F_{S/C}$$

where:

$\Sigma M_0$=sum of the moments about the top portion 52

$F_{S/C}$=force of the screws 46, 48 on the section 42;

$F_{GB/C}$=normal contact force of the gas block 14 on the section 42 ("clamp force").

In one exemplary embodiment, the distance Y can be about 0.376 inches, while the distance R can be about 0.266 inches, and the force applied by the screws $F_{S/C}$ can be about 500 lbf. Using such example values, the clamp force applied in the exemplary embodiment is approximately $F_{GB/C}$=706 lbf.

It therefore can be seen that the construction of the clamped gas block apparatus according to the principles of the present disclosure provides a clamp that allows accurate positioning and alignment of the gas block and efficiently transfers the screw force on the clamp to the gas block without requiring brazing or other permanent attachment methods.

The corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

What is claimed is:

1. A gas block clamping apparatus for a firearm, the apparatus comprising:

a gas block including at least one bracket section having an upper flange and a lower section;

a plurality of clamp sections disposed on opposite sides of the at least one bracket section, each clamp section having a top portion for engaging a notch defined along a barrel of the firearm, and a clamp protrusion engaging the upper flange of the gas block; and at least one fastener engaging at least one clamp section of the plurality of clamp sections and the at least one bracket section of the gas block.

2. The gas block clamping apparatus of claim 1, wherein each clamp section comprises a substantially C-shaped member extending between the top portion and the clamp protrusion, and wherein the top portion further comprises a lip configured to engage and fit within the notch.

3. The gas block clamping apparatus of claim 1, wherein each clamp section of the plurality of clamp sections comprises a lower flange defining at least one bore, and the at least one fastener engages the at least one bore.

4. The gas block clamping apparatus of claim 3, wherein the at least one fastener comprises a first fastener and a second fastener, and the at least one bore of each clamp section comprises a first through bore and a second through bore, wherein the first fastener engages the first through bore of a first clamp section of the plurality of clamp sections and the second through bore of a second clamp section of the plurality of clamp sections, and the second fastener engages the first through bore of the second clamp section and the second through bore of the first clamp section.

5. The gas block clamping apparatus of claim 4, wherein the first through bore of each clamp section further comprises a clearance fit with the respective first or second fastener and the second through bore of each clamp section is threaded for engaging a thread on the respective first or second fastener.

6. The gas block clamping apparatus of claim 3 wherein the at least one fastener is adapted to apply a generally lateral force to the lower flange of each of the clamp sections to cause each of the clamp protrusions to apply a clamping force to the upper flange of the gas block, wherein the lateral force and the clamping force cause the top portions to pull down against the notches.

7. The gas block clamping apparatus of claim 1, further comprising a recess formed in a lower surface of the barrel, an alignment element engaging the recess of the barrel and the upper flange of the gas block, and an alignment pin engaging a first alignment bore in the alignment element and a second alignment bore in the at least one bracket section for at least partially aligning the gas block with the barrel.

8. The gas block clamping apparatus of claim 7, wherein the upper flange of the gas block comprises a concave inner surface engaging the alignment element, and the alignment element comprises a generally flat surface for engaging the recess, and wherein the clamp protrusion of each clamp section engages the outer surface of the upper flange for applying the clamping force to the barrel via the alignment element.

9. The gas block clamping apparatus of claim 1, wherein the bracket section comprises a gas port adapted to align with a gas duct in the barrel as the gas block is brought into clamping engagement with the barrel.

10. A firearm, comprising:

a barrel defining a chamber and having at least two notches situated along the barrel;

a gas block comprising a housing and a bracket with an upper flange;

a clamp apparatus comprising at least two clamp sections, wherein each clamp section comprises a top portion adapted to engage a corresponding one of the at least two notches in the barrel, and a clamp protrusion engaging the upper flange of the gas block; and at least one fastener engaging at least one clamp section of the plurality of clamp sections and the bracket of the gas block for drawing the clamp section and bracket into clamping engagement with the barrel.

11. The firearm of claim 10, wherein each of the at least two notches is elongate and extends generally longitudinally.

12. The firearm of claim 11, further comprising a recess formed in a lower surface of the barrel, an alignment element engaging the recess of the barrel and the upper flange of the gas block, and an alignment pin engaging a first alignment bore in the alignment element and a second alignment bore in the at least one bracket section for at least partially aligning the gas block with the barrel.

13. The firearm of claim 12, wherein the upper flange of the gas block comprises a concave inner surface engaging the alignment element, and the alignment element comprises a generally flat surface adapted to engage the recess, and wherein the clamp protrusion of each clamp section engages the outer surface of the upper flange for applying the clamping force to the barrel via the alignment element.

14. The firearm of claim 12, wherein the barrel further comprises a transverse gas duct communicating from an interior portion of the barrel to an exterior portion of the barrel and the bracket comprises a gas port communicating from the upper flange to the housing, wherein the gas port is aligned with the gas duct by attaching the alignment element to the bracket with the alignment pin and inserting the alignment element into the recess.

15. The firearm of claim 14, wherein the at least one fastener comprises a first fastener on one side of the clamp apparatus and a second fastener on an opposite side of the clamp apparatus, and wherein the gas port is aligned with the gas duct by tightening the first and second fasteners in an alternating fashion.

16. The firearm of claim 10, wherein at least a portion of at least one of the at least two notches extends in a direction generally transverse to the barrel.

17. The firearm of claim 10, wherein each clamp section comprises a substantially C-shaped member extending between the top portion and the clamp protrusion, and wherein the top portion further comprises a lip configured to engage and fit within the corresponding one of the at least two notches.

18. The firearm of claim 10, wherein each clamp section of the plurality of clamp sections comprises a lower flange defining at least one bore, and the at least one fastener engages the at least one bore.

19. The firearm of claim 18, wherein the at least one fastener comprises a first fastener and a second fastener, and the at least one bore of each clamp section comprises a first through bore and a second through bore, wherein the first fastener engages the first through bore of a first clamp section of the at least two clamp sections and the second through bore of a second clamp section of the at least two clamp sections, and the second fastener engages the first through bore of the second clamp section and the second through bore of the first clamp section.

20. The firearm of claim 19, wherein the first through bore of each clamp section provides a clearance fit with the respective first or second fastener and the second through bore of each clamp section is threaded for engaging a thread on the respective first or second fastener.

21. The firearm of claim 18 wherein the at least one fastener is adapted to apply a generally laterally directed force to the lower flange of each of the clamp sections to cause each of the clamp protrusions to apply a clamping force to the upper flange of the gas block, wherein the laterally directed force and the clamping force cause the top portions to pull down against the notches.

* * * * *